US006938507B2

(12) United States Patent
Fisher

(10) Patent No.: US 6,938,507 B2
(45) Date of Patent: Sep. 6, 2005

(54) ACTUATOR

(75) Inventor: Sidney Edward Fisher, West Midlands (GB)

(73) Assignee: Meritor Light Vechicle Systems (UK) Limited, Birmingham (GB)

( * ) Notice: Subject to any disclaimer, the term of this patent is extended or adjusted under 35 U.S.C. 154(b) by 108 days.

(21) Appl. No.: 09/996,189

(22) Filed: Nov. 28, 2001

(65) Prior Publication Data

US 2002/0073789 A1 Jun. 20, 2002

(30) Foreign Application Priority Data

Nov. 29, 2000 (GB) ..... 0029058

(51) Int. Cl.[7] ..... F16H 29/02

(52) U.S. Cl. ..... 74/89.16; 74/567; 292/201; 292/DIG. 23

(58) Field of Search ..... 74/89.16, 107, 74/567, 569; 292/201, 216, DIG. 23, DIG. 27; 70/271, 278.7, 277, 264, 190, 192; 318/466–468

(56) References Cited

U.S. PATENT DOCUMENTS 4,926,707 A 5/1990 Yamada
5,409,277 A 4/1995 Rogers, Jr. et al.
5,649,726 A 7/1997 Rogers, Jr. et al.
6,114,821 A * 9/2000 Kachouh ..... 318/466
6,208,103 B1 * 3/2001 Kachouh ..... 318/468

FOREIGN PATENT DOCUMENTS

| | | |
|---|---|---|
| DE | 198 61 096 A1 | 1/2000 |
| EP | 0 490 142 A1 | 11/1991 |
| EP | 0 808 979 A2 | 11/1997 |
| EP | 0 906 997 A1 | 4/1999 |
| EP | 0 974 718 A2 | 1/2000 |
| FR | 2 477 762 A | 9/1981 |
| GB | 2 204 351 A | 11/1988 |
| WO | WO 99/13188 | 3/1999 |

* cited by examiner

*Primary Examiner*—Pam Rodriguez
(74) *Attorney, Agent, or Firm*—Carlson, Gaskey & Olds

(57) ABSTRACT

An actuator including a motor in driving connection with a cam rotatable about a cam axis, the actuator further including a cam follower connected to an output member, in which powered rotation of the cam causes the cam follower to be radially displaced relative to the cam axis to provide differing output positions of the output member and in which the profile of the cam includes a radial stop which, in conjunction with the cam follower, act as a detent so that the cam follower is capable of controlling the position of the cam.

23 Claims, 7 Drawing Sheets

ACTUATOR

BACKGROUND OF THE INVENTION

The present invention relates to actuators, and in particular actuators for use in association of vehicle door locks such as car (automobile) door locks.

Known vehicle door locks actuators are required to provide an output position corresponding to an unlocked condition of the associated door and also an output position corresponding to a locked condition of the associated door.

Furthermore some vehicle door lock actuators are further required to provide an output position corresponding to a superlocked condition of a vehicle door.

For the avoidance of doubt, the term locked is used to mean that a door is unable to be opened from the outside but can be opened from the inside, and the term superlocked is used to mean a door which cannot be opened from either the inside or the outside.

SUMMARY OF THE INVENTION

An object of the present invention is to provide an improved form of actuator.

Thus according to the present invention there is provided an actuator including a motor in driving connection with a cam rotatable about a cam axis, the actuator further including a cam follower connected to an output member, in which powered rotation of the cam causes the cam follower to be radially displaced relative to the cam axis to provide differing output positions of the output member and in which the profile of the cam includes a radial stop which, in conjunction with the cam follower, act as a detent so that the cam follower is capable of controlling the position of the cam.

Advantageously such an arrangement can use one basic actuator assembly and by interchanging of the cam arrangement can provide for an actuator which locks/unlocks an associated door lock or alternatively locks/unlocks/superlocks an associated door lock.

Furthermore such an arrangement advantageously provides for a motor that only needs to be powered in one direction.

BRIEF DESCRIPTION OF THE DRAWINGS

The invention will now be described, by way of example only, with reference to the accompanying drawings in which.

DETAILED DESCRIPTION OF THE PREFERRED EMBODIMENT

Figure 2:
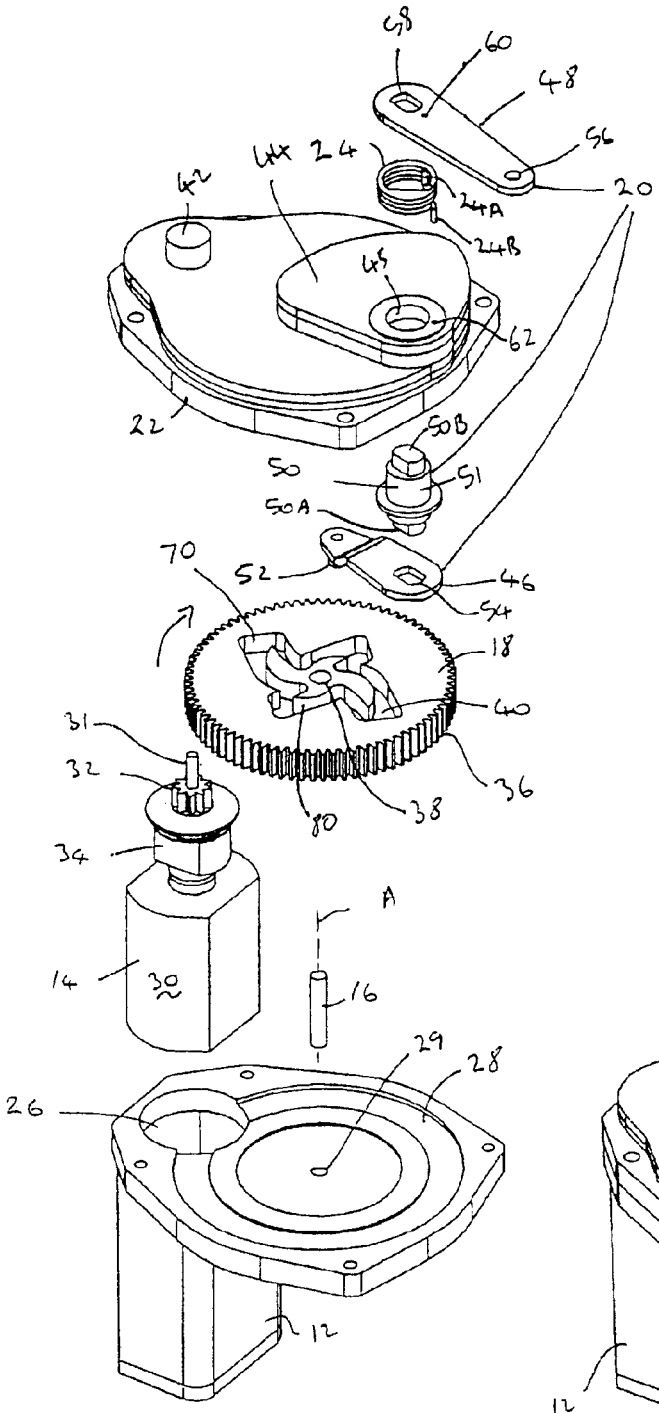
FIG. 2 is an exploded view of FIG. 1.

With reference to FIGS. 1 to 7 there is shown an actuator 10 including a housing 12, a motor 14, a pivot pin 16, a cam wheel 18 and an output member 20, a housing cover 22 and a spring 24. Housing 12 includes a motor recess 26 and a cam wheel recess 28. Motor assembly 14 includes a motor 30 driveably connectable to an output pinion 32 via a centrifugal clutch 34.

Cam wheel 18 includes an array of teeth 36 for engagement with output pinion 32, and a central hole 38 to allow the cam wheel to be pivotably mounted on pivot pin 16. Cam wheel 18 further includes a recess 40 which will be described further below.

Housing cover 22 is generally planar in form and includes a recess (not shown) within boss 42 to receive shaft 31 of motor assembly 14, a recess (not shown) corresponding to cam wheel recess 28, and a lever recess (not shown) within boss 44 to allow the output lever to rotate as will be described further below.

Output member 20 includes levers 46 and 48 and pivot pin 50. Lever 46 includes a cam follower 52 at one end thereof for engagement with recess 40 and a hole 54 at the other end thereof, profiled in such a manner as to engage end 50A of pin 50 in a press fit and rotationally fast manner.

Lever 48 includes a hole 56 at one end thereof connectable in use to a component (not shown) to be actuated. A hole 58 is positioned at the other end of lever 48, profiled to engage in a press fit manner and rotationally fast with end 50B of pivot pin 50.

Lever 48 further includes a spring hole 60 trough which end 24A of spring 24 passes. Another end 24B of spring 24 is inserted into spring hole 62 of boss 44.

When assembled:

Motor assembly 14 sits in motor recess 26 with shaft 31 engaging and being supported by the hole within boss 42.

Cam wheel 18 sits in recess 28 and the corresponding recess (not shown) of cover 22 with the array of gear teeth 36 in engagement with pinion 32, and central hole 38 being mounted on pivot pin 16 which in turn is mounted in hole 29 of housing 12 and a corresponding hole (not shown) beneath boss 44.

The output member is assembled such that a part of mid portion 51 of pivot pin 50 is pivotally mounted within hole 45 of boss 44, and spring 24 is mounted around an adjacent part of mid portion 51.

In particular spring 24 is arranged such that the output member 20 is biased in a clockwise direction when viewed in the direction of arrow A i.e. cam follower 52 is biased in a radially outward direction relative to the axis 16A of pivot pin 16.

When motor 30 is energised the centrifugal clutch 34 will engage, hence driving pinion 32 in an anticlockwise direction when viewed in the direction of arrow A causing the cam wheel to rotate in a clockwise direction when viewed in the direction of arrow A. This rotation of the cam wheel will cause the cam follower 52 to follow the profile of recess 40 and cause the output member to pivotally reciprocate as will be described further below.

Furthermore external reciprocation of the output member 20 (e.g. by manual reciprocation) will cause the cam follower 52 to drive the cam wheel 18 in a clockwise direction. Such rotation causes output pinion 32 to also rotate, though motor 30 is not rotated since the centrifugal clutch 34 is not engaged.

Figure 7:
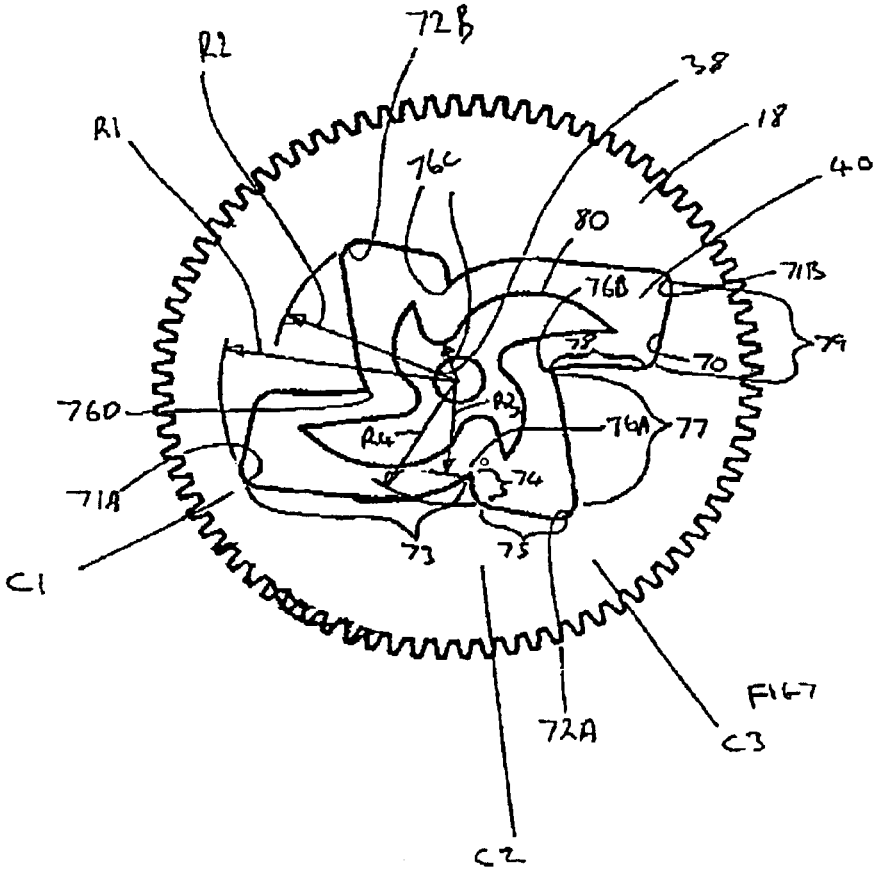
FIG. 7 shows an axial view of the cam arrangement of FIG. 1 in isolation.

Consideration of FIG. 7 shows the cam wheel 18 in more detail.

In particular recess 40 includes an outer wall 70 and an inner wall 80 which together form a cam. Outer wall 70 includes two first radial stops 71A and 71B both located at radius R1 from axis A. Outer wall 70 further includes radial stops 72A and 72B, both located at radius R2 from axis A. Note that radius R2 is smaller than radius R1. Stops 71A, 71B, 72A and 72B act to limit the outward movement of the cam follower.

The profile of the outer wall 70 between stop 71A and 72A is split into three distinct portions 73, 74 and 75.

Spirally curved portion 73 starts at stop 71A at circumferential position C1 and spirals inwards to edge 76A at radius R3 and circumferential position C2. It should be noted that radius R3 is less than radius R1.

For the avoidance of doubt term inward spiral refers to a curved traced by a point which rotates about a fixed position towards which it continually approaches, and the term outward spiral should be construed accordingly. In particular a straight line is a special form of curve and the term spiral curve includes for example and embodiment wherein stop 71A is connected to edge 76A by a straight line.

It should be noted that the exact form of spirally curved portion 73 can be varied, for example it could be part of an archimedian spiral, part of a circle, part of an ellipse, or other forms. The significant point is that point 76A is circumferentially displaced from stop 71A and is radially closer to axis A than stop 71A.

Portion 74 is substantially radially orientated. Portion 75 comprises an outward spirally curved portion. The portion of outer wall between stop 72A and 71B has equivalent inwardly spirally curved portion 77, substantially radially orientated portions 78 and outwardly spirally curved portion 79.

In particular it should be noted that portion 78 should be regarded as a substantially radially orientated portion even though in fact it is part of an arc, the centre of which is the axis of pivot pin 50 when the cam follower is situated adjacent this portion of the outer wall. The form of portion 78 thus allows the cam follower to move substantially radially relative to axis A without causing the cam wheel to rotate.

Three corresponding portions (not marked for clarity) can be identified between stop 71B and stop 72B and three corresponding portions (not marked for clarity) can be identified between stop 72B and stop 71A.

Figure 8:
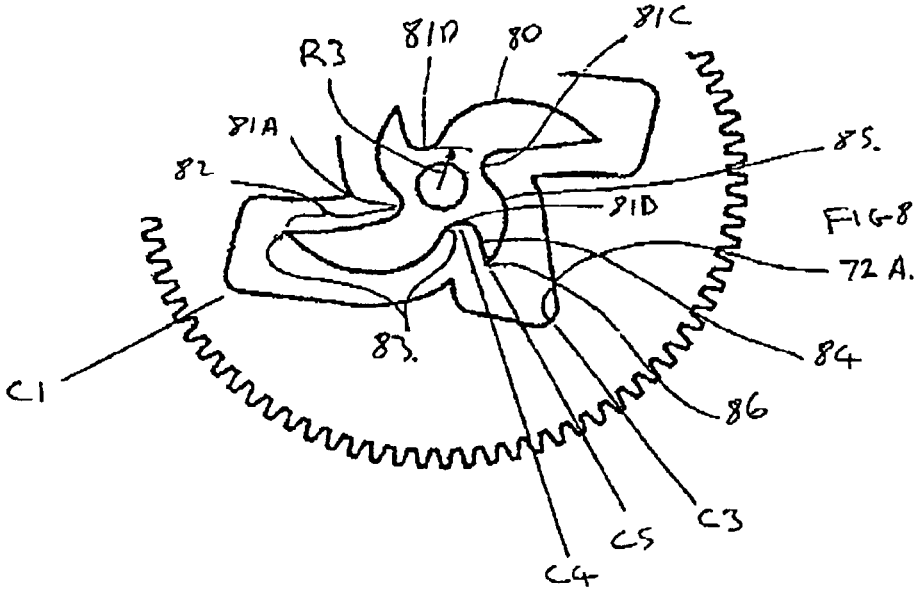
FIG. 8 shows a partial view of FIG. 7.

With reference to FIG. 8 it can be seen that inner wall 80 includes third radial stops 81A, 81B, 81C and 81D, all positioned at radius R3 from axis A. Consideration of the outer wall profiled between stop 81A and 81B shows a substantially radially orientated portion 82 and an inwardly spirally curved portion 83. The profile of the inner wall between stops 81B and 81C includes a substantially radially orientated portion 84 and an inwardly spirally curved portion 85. Equivalent portions (not marked for clarity) can be identified between stops 81C and 81D and also between stops 81D and 81A.

It should be noted that the circumferential position C4 of inner stop 81B is circumferentially between the circumferential positions C1 and C3 of outer stops 71A and 72A respectively.

Furthermore it can be seen that the circumferential position C4 of stop 81*b* is circumferentially offset (mis-aligned) from edge 86 (positioned at circumferential position C5) edge 86 is also circumferentially offset from stop 72*a* (compare positions C5 and C3).

Figure 3:
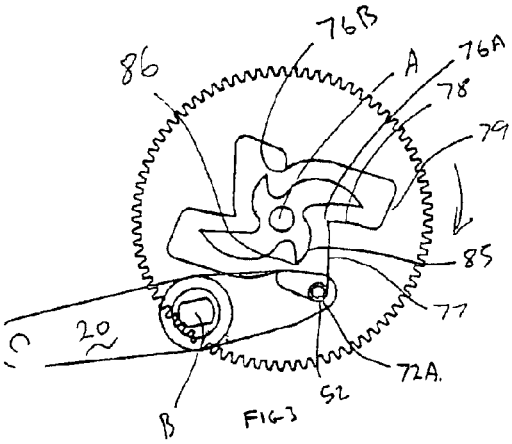
FIGS. 3 to 6 show an axial view of some of the components of the actuator of FIG. 1 in various position.

Powered operation of the actuator is as follows:

Consideration of FIG. 3 shows the actuator in a stationary position with the cam follower 52 being biased in a radially outward direction by spring 24. Cam follower 52 is limited in its outward movement by engagement with stop 72A.

The motor is energised such that the cam wheel is caused to rotate in a clockwise direction whereupon portions 77, 78 and 79 progressively move past cam follower 52. As portion 77 moves pass cam follower 52 the cam follower progressively moves radially inwardly relative to axis A causing the output member 20 to rotate in an anticlockwise direction about axis B.

As the end of portion 77 adjacent portion 78 moves pass cam follower 52, the output member 'snaps' clockwise under the influence of spring 24 until such time as the cam follower 52 abuts the end of portion 79 adjacent portion 78. Continued rotation of the cam wheel 18 in a clockwise direction causes the portion 79 to move past cam follower 52 until such time as the actuator achieves the position as shown in FIG. 4 whereupon cam follower 52 engages stop 71B.

Figure 4:
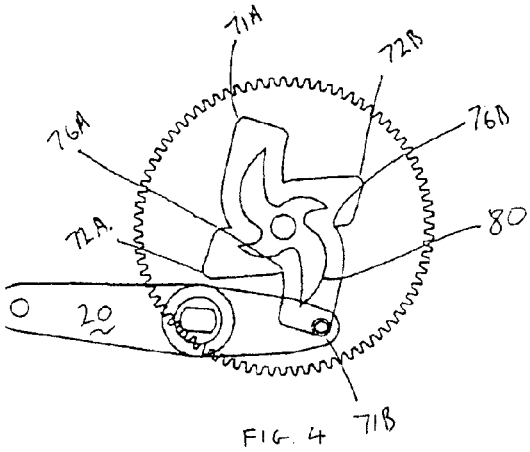

It should be noted that due to the radial difference between stop 72A and 71B the output member 20 is in a different position when comparing FIGS. 3 and 4. It should be noted that motor 30 is energised with a pulse of predetermined duration and provided that edge 76A has passed under cam follower 52 and provided that edge 76B has not passed under cam follower 52 then whenever the pulse of energy ceases with the cam follower between these two edges, the spring 24 will cause the cam wheel to return or advance to the position as shown in FIG. 4 since this is the radially outer most position achievable by the cam follower between edges 76A and 76B. It can be seen that the cam follower and radial stop 71B act in conjunction to form a detent which is capable of controlling the position of the cam, in this case when the motor is not being powered.

A further pulse of energy to motor 30 will cause stop 72B to move beneath the cam follower. Note that at this position the output member 20 will be in the position as shown at FIG. 3 but the cam wheel will be rotated 180 degrees from the position as shown in FIG. 3. A further pulse of energy to the motor will move stop 71A beneath cam follower 52 and a yet further pulse of energy will move stop 72A beneath cam follower 52 returning the actuator to the position as shown in FIG. 3.

Note that during powered operation cam follower 52 only need engage the outer wall 70 and no contact is required between cam follower 52 and inner wall 80.

It is possible to externally actuate the output member 20 to rotate the cam wheel 18 under these circumstances the sequence of movements are shown sequentially in FIG. 3, FIG. 5, FIG. 4 and FIG. 6.

Figure 5:
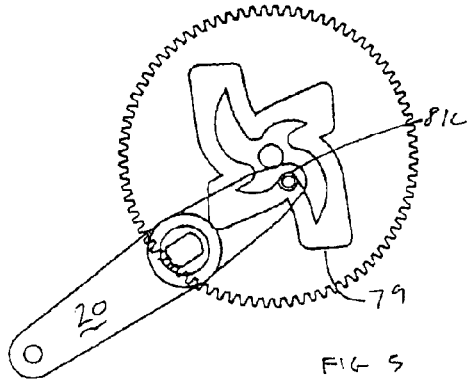

Thus manual actuation of the output member 20 in an anticlockwise direction about axis B causes cam follower 52 to disengage the outer wall and engage the inner wall at portion 85, since edge 86 is circumferentially offset from stop 72A. Continued anticlockwise movement of output member 20 results in cam follower 52 moving substantially radially inwardly relative to axis A causes a camming action between cam follower 52 and portion 85 resulting in clockwise rotation of cam wheel to the position as shown in FIG. 5, whereupon cam follower 52 engages stop 81C. It can be seen that the cam follower and stop 81C act in conjunction as a detent to control the position of the cam, in this case during manual operation of the output member 20.

Release of output member 20 results in output member snapping clockwise under the influence of spring 24 until such time as cam follower 52 engages an end of portion 79 of the outer wall. Spring 24 continues to bias cam follower 52 in a radially outward direction resulting in the camming action between cam follower 52 and portion 79 until such time as the actuator achieves the position as shown in FIG. 4.

Figure 6:
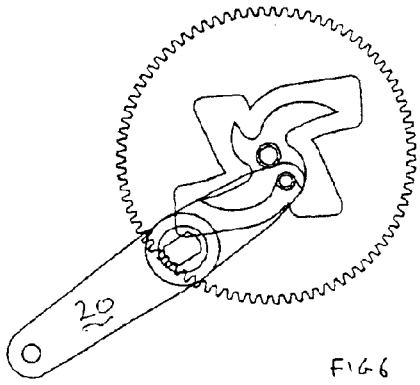

A further manual actuation of the output member in an anticlockwise direction about axis B causes cam follower 52 to disengage the outer wall and engage the inner wall at portion 80 causing the actuator to move to the position as shown in FIG. 6. Subsequent release of the output member will cause this component to move to the position as shown in FIG. 3 under the influence of spring 24 (though it should be noted that the cam wheel will be positioned 180 degrees from the position as shown in FIG. 3).

Thus it can be seen that progressive pulses of energy to the motor can cause the output member to move between the position as shown in FIGS. 3 and 4. Furthermore the output member can be caused to move between these two positions by successive manual or other external actuation of the output member 20.

As mentioned above, the spring 24 acts to bias the cam follower radially outwardly relative to the cam wheel axis. A person skilled in the art would readily appreciate that it is also possible to arrange the spring to bias the cam follower radially inwardly and to provide an appropriate cam formation.

With reference to FIGS. 9 to 16 there is shown a second embodiment of an actuator 110 in which components which fulfil substantially the same function as those in actuator 10 are labelled 100 greater.

Note that recess 140 is of a different profile to recess 40.

Furthermore housing cover 122 does not include a hole equivalent to spring hole 62 and lever 148 does not include a hole equivalent to spring hole 60. However, housing cover 122 does include a projection 90 having sides 90A and 90B separated by distance W and lever 148 includes a tab 91 having sides 91A and 91B also separated by width W.

Figure 9:
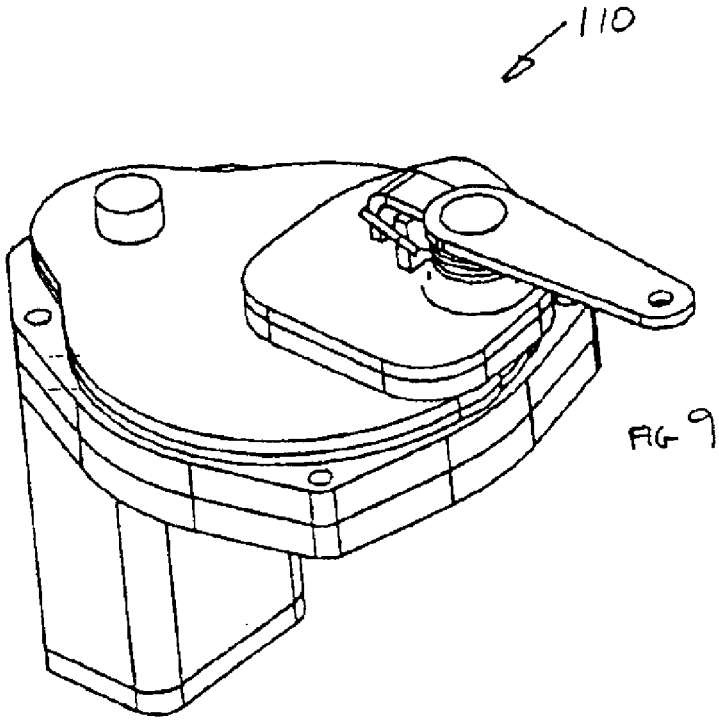
FIG. 9 is a view of a further actuator according to the present invention.

Spring 124 has ends 124A and 124B which are generally tangentially orientated relative to the body of spring 124 with end 124A lying adjacent side 90A and 91A and end 124B lying adjacent side 90B and 91B when assembled (see FIG. 9). The combination of projection 90, tab 91 and spring 124 act to bias tab 91 in line with projection 90. Thus if lever 148 where to be biased clockwise when viewing FIG. 10 in the direction of arrow D, edge 91B would engage and move end 124B clockwise whilst end 124A of spring 124 would engage stationary edge 90A. This results in winding up of spring 124 which in turn biases lever 148 to a position such that projection 90 aligns with tab 91. Clearly rotation of lever 148 anticlockwise when viewing FIG. 10 in the direction of arrow D causes edge 91A to engage and move end 124A whilst end 124B engages stationary edge 90B of projection 90. This again causes spring 124 to be wound up and hence the spring biases lever 148 to a position such that projection 90 aligns with tab 91.

Figure 11:
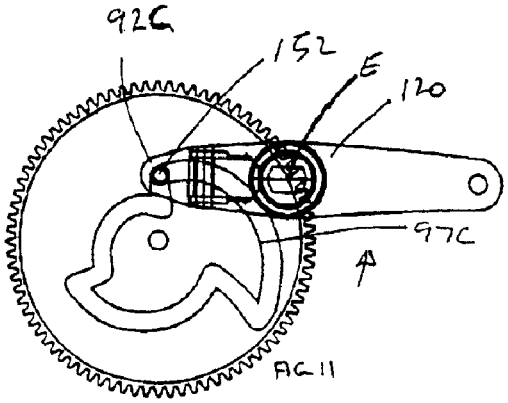
Figure 13:
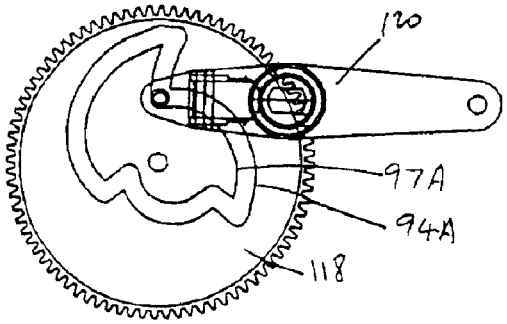
Figure 15:
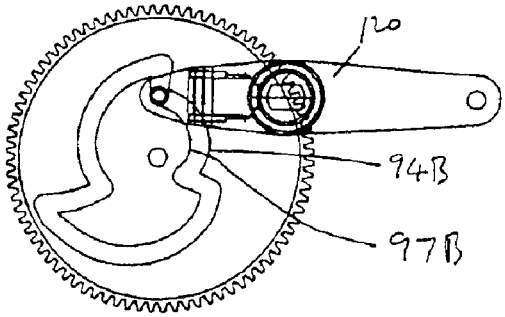

FIGS. 11, 13 and 15 show the position of the output member 120 when tab 91 is aligned with projection 90.

Figure 17:
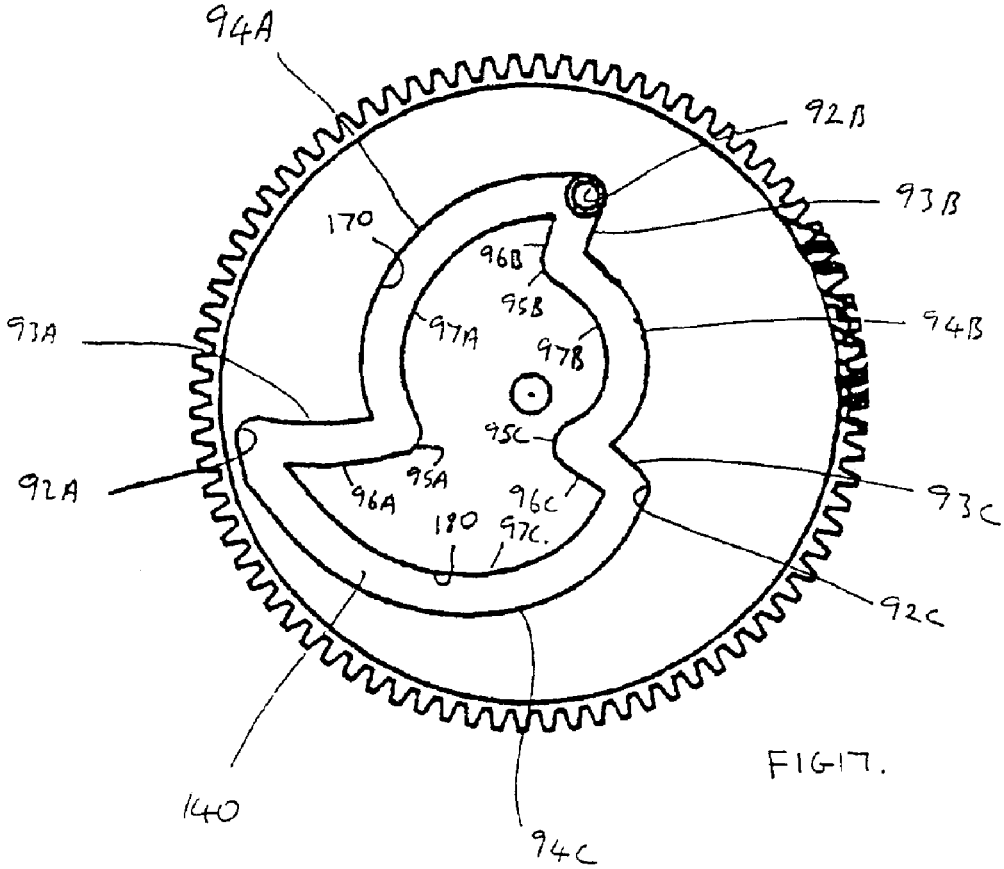
FIGS. 17 shows an axial view of the cam arrangement of FIG. 9.

Consideration of FIG. 17 shows that recess 140 includes outer wall 170 and inner wall 180. Outer wall 170 includes stops 92A, 92B and 92C, substantially radially orientated portions 93A, 93B and 93C and spirally curved portions 94A, 94B and 94C. It should be noted that spirally curved portions 94A and 94C spiral outwards whilst spirally curved portion 94B spirals inwardly.

Inner wall 180 includes stops 95A, 95B and 95C substantially radially orientated portions 96A, 96B and 96C and spirally curved portions 97A, 97B and 97C. It should be noted that spirally curved portions 97A and 97C spiral outwards whilst spirally curved portion 97B spirals inwards.

Figure 1:
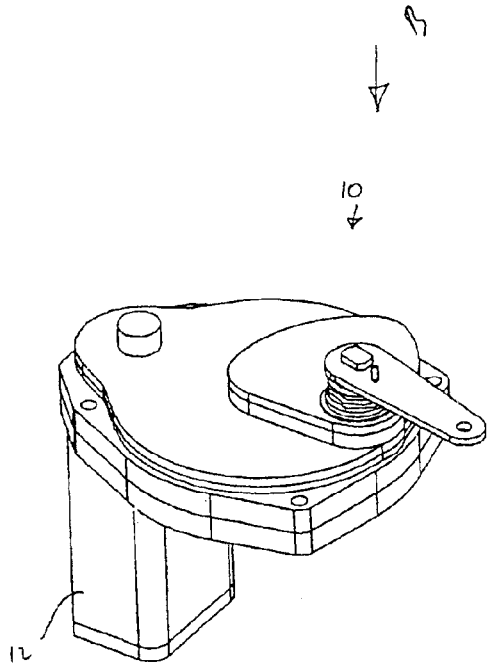
FIG. 1 is a view of an actuator according to the present invention.

Powered operation of the actuator is as follows:

With the actuator in the position as shown in FIG. 1 the cam follower 152 abuts stop 92C. Powering of the motor causes the cam wheel 118 to rotate anticlockwise such that spirally curved portion 97C engages and cams out cam follower 152.

Figure 12:
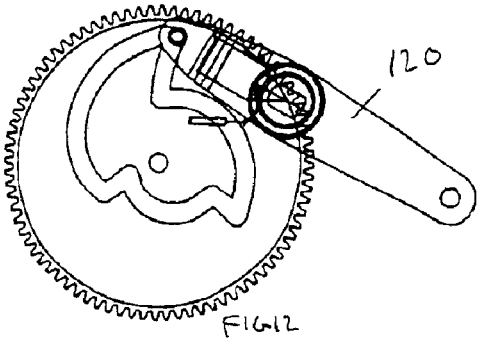

Output member 120 will momentarily achieve the position as shown in FIG. 12 following which it will snap back to the position as shown in FIG. 13.

A subsequent energization of the motor will again rotate the cam 180 degrees counter-clockwise when viewing FIG. 13 whereupon cam follower 152 will engage with and be cammed out by spirally curved portion 97A. The output member 120 will momentarily achieve the position as shown in FIG. 14 following which it will snap back to the position as shown in FIG. 15 under the influence of spring 124.

A further energization of the motor will again cause the cam wheel 118 to rotate anticlockwise following which the cam follower 152 will engage and be cammed inwardly by spirally curved portion 94B of the outer wall 170. The output member 120 will momentarily achieve the position as shown in FIG. 16, following which it will snap back to the position as shown in FIG. 11.

Figure 16:
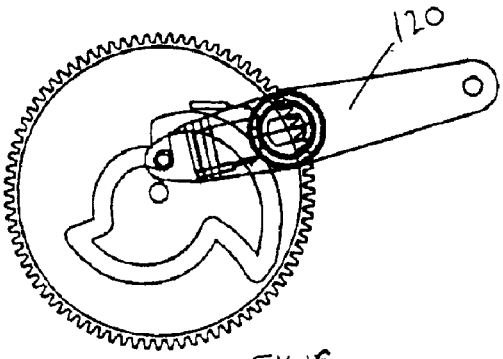
Figure 14:
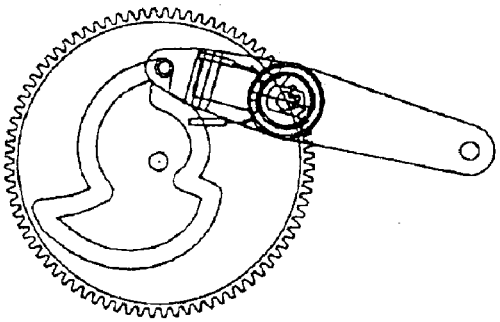

Note that in moving between the positions as shown in FIGS. 11, 12 and 13 the output member moves clockwise and anticlockwise, in moving between the position as shown in FIGS. 13, 14 and 15 the output member moves clockwise then anticlockwise, but in moving between the position as shown in FIGS. 15, 16 and 11 the output member initially moves anticlockwise and then moves clockwise. Furthermore the output member 120 has moved further clockwise in FIG. 12 than in FIG. 14.

It is also possible to externally actuate the output member 120 e.g. by manual operation. Thus starting at FIG. 11 manually moving the output member 120 clockwise about axis E of pivot pin 150 causes the actuator to move to the position as shown in FIG. 12 subsequent release of the output member 120 causes the actuator to move (snap) to the position as shown in FIG. 13. Subsequent clockwise rotation of output member 120 causes the cam follower 152 to engage spirally curved position 94A resulting in the actuator moving to the position as shown in FIG. 14. Subsequent release of the output member 120 causes the actuator to move (snap) to the position as shown in FIG. 15. Subsequent manual rotation of the output lever 120 in an anticlockwise direction causes the cam follower to engage spirally curved portion 97B and move to the position as shown in FIG. 16. Subsequent release of the output member 120 causes the actuator to move (snap) to the position as shown in FIG. 11.

Note that in the position shown in FIGS. 11, 13 and 15, it is not possible for the cam wheel to be rotated in a clockwise direction since cam follower 152 is in abutment with stops 95A, 95B, 95C as appropriate. As such these stops also act to prevent back rotation of the cam wheel.

Figure 18:
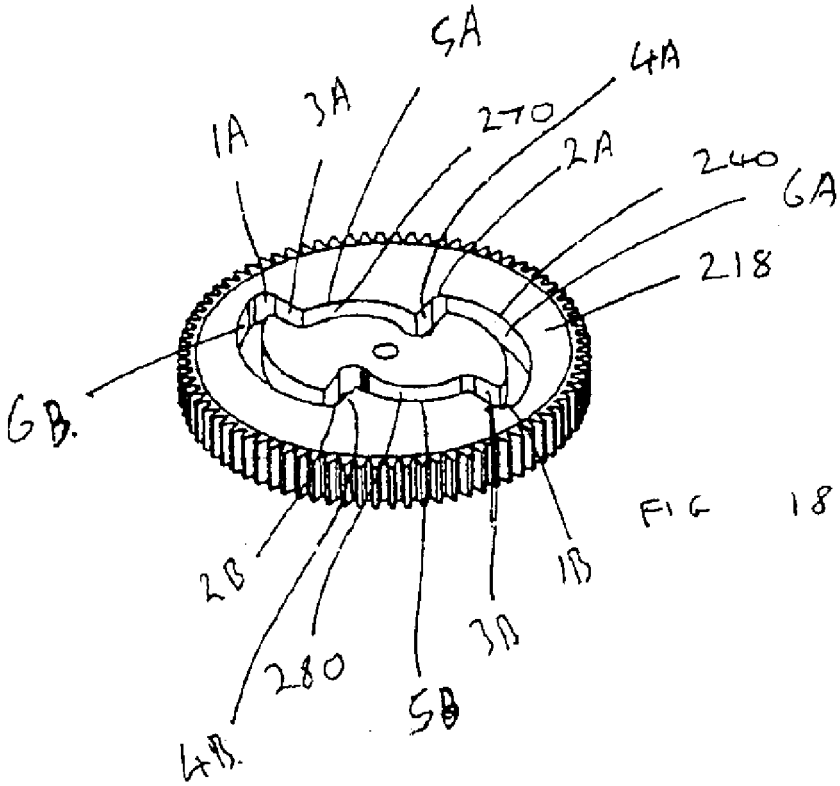
FIG. 18 shows an isometric view of an alternative cam arrangement for use in the actuator of FIG. 9.
Figure 10:
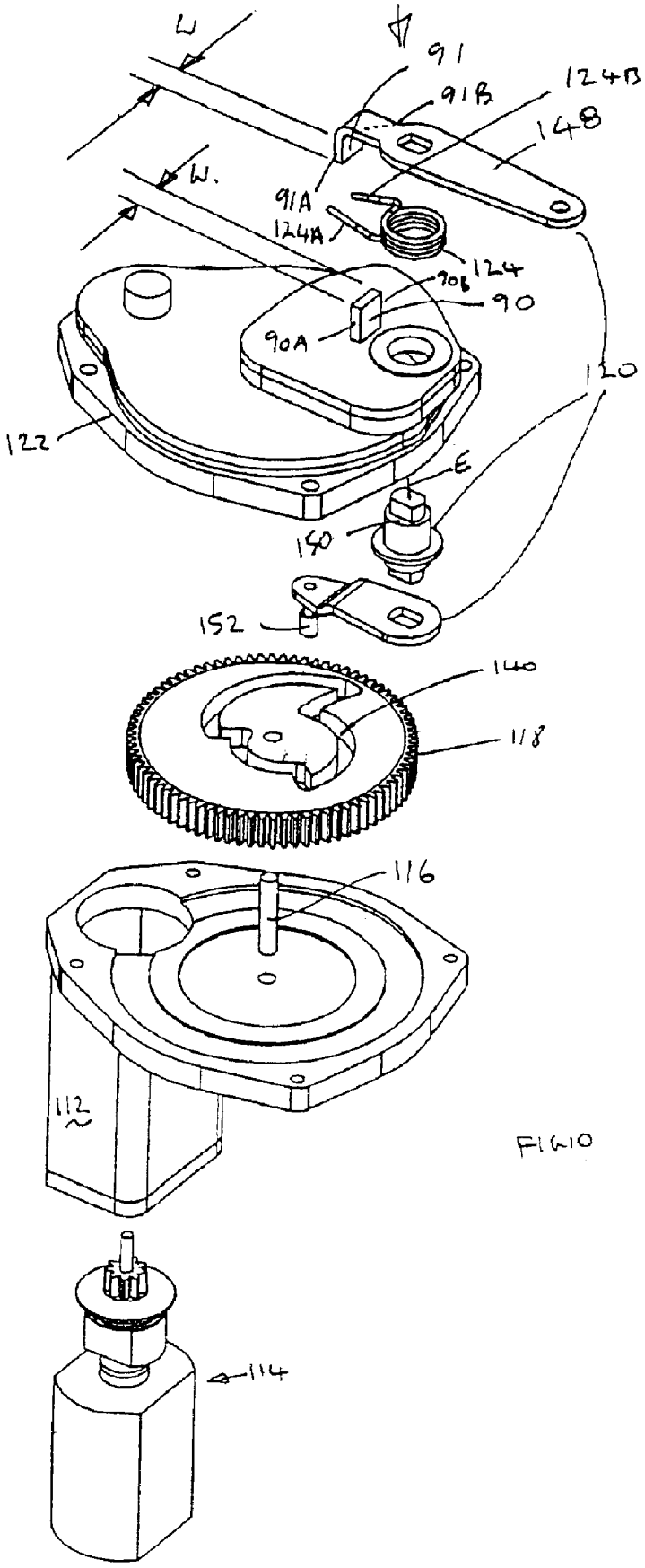
FIG. 10 is an exploded view of FIG. 9, FIGS. 11 to 16 show an axial view of some of the components of the actuator of FIG. 9 in various positions.

Consideration of FIG. 18 shows an alternative cam wheel 218 suitable for use in the actuator 110. In this case recess 240 is of a differing profile and in particular is rotationally symmetrical through 180 degrees, i.e. the view shown in FIG. 18 is identical the same view when the cam wheel has been rotated through 180 degrees.

Outer wall 270 includes an diametrically opposed stops 1A and 1B and diametrically opposed stops 2A and 2B. The outer wall 270 further includes substantially radially orientated portions 3A, 3B, 4A and 4B the outer wall further includes inwardly spirally curved portions 5A and 5B and outwardly spirally curved portions 6A and 6B. Corresponding stops, substantially radially orientated portions and spirally curved portions can be found on inner wall 280.

When cam wheel 280 is used in the actuator 110 in place of cam wheel of cam wheel 118 it provides for two 'momentary' or 'powered' output positions of the output member 120 (rather than the three 'momentary' positions as shown in FIGS. 16, 12 and 14 when using cam wheel 118). This is because of the 180-degree rotational symmetry of cam 218. Thus for example the stops 1A and 1B are positioned at the same radius and stops 2A and 2B are also positioned at the same radius (though different from the radius of stops and 1A and 1B). The two 'momentarily' output positions associated with cam wheel 218 are positioned one on either side of the rest position of the output member 120, i.e. the position to which it is biased towards bias spring 124.

Any form of motor can be used but in particular DC electric motors are particularly suitable as are electric stepper motors.

The embodiments thus far described show a cam follower in the form of a pin which is positioned in a groove which provides for the cam profile. In further embodiments different cam profile and cam follower arrangements could be used in particular a twin pronged fork cam follower could be used with a fork being provided on either side of a rail, the rail being shaped to provide the cam profile.

The embodiments described show the cam axis being parallel to the motor axis. In further embodiments this need not be the case, in particular the motor axis could be at 90° to the cam axis there being a worm gear arrangement for operably connecting the motor to the cam.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. An actuator comprising:

a motor, a cam rotatable about a cam axis and drivable by the motor;

a cam follower;

an output member connected to the cam follower, wherein powered rotation of the cam causes the cam follower to be radially displaced relative to the cam axis to provide first and second output positions of the output member, wherein the cam has a profile that includes a radial stop which, in conjunction with the cam follower, act as a detent so that the cam follower is capable of controlling a position of the cam, and wherein the motor is powered in a single direction to move the output member from the first output position to the second output position and is driven in the single direction to move the output member from the second output position to the first output position.

2. The actuator as defined in claim 1, wherein the radial stop and cam follower act as a detent when the motor is not being powered.

3. The actuator as defined in claim 1, wherein external actuation of the output member causes rotation of the cam.

4. The actuator as defined in claim 3, wherein the radial stop and cam follower act as a detent during external actuation of the output member.

5. The actuator as defined in claim 1, wherein the cam has a first radial stop to stop the cam follower at a first radius and a second radial stop to stop the cam follower at a second radius, wherein the first and second radii are different.

6. The actuator as defined in claim 5 in which the cam has a third radial stop to stop the cam follower at a third radius, the first, second and third radii being different.

7. The actuator as defined in claim 5, wherein the cam has a plurality of first and second radial stops.

8. The actuator as defined in claim 1, wherein the cam follower is biased radially outwardly relative to the cam axis.

9. The actuator as defined in claim 1 in which the cam follower is biased radially inwardly relative to the cam axis.

10. The actuator as defined in claim 1 in which the cam follower is capable of moving between an radially outer position and a radially inner position and the cam follower is biased to a bias position radially between the radially outer and radially inner position.

11. The actuator as defined in claim 1, wherein the cam has a first radial stop to stop the cam follower at a first radius and a second radial stop to stop the cam follower at a second radius, wherein the cam profile between the first and second stops is profiled such that the cam follower moves to a radius which is different than both the first and second radii.

12. The actuator as defined in claim 1, wherein the cam profile includes a spirally inwardly curved portion.

13. The actuator as defined in claim 1 in which the cam profile includes a spirally outwardly curved portion.

14. The actuator as defined in claim 1, wherein the cam profile includes a first substantially radially orientated portion to allow the cam follower to move radially inwards or outwards relative to the cam axis.

15. The actuator as defined in claim 1, wherein the cam profile includes a return stop to prevent the backward rotation of the cam past the return stop.

16. The actuator as defined in claim 1, wherein a powered position corresponds to each of the output positions of the actuator.

17. The actuator as defined in claim 1 having an at rest position differing from the powered output position of the actuator.

18. The actuator as defined in claim 1, wherein the actuator is adapted for a vehicle door locking system to provide locking and unlocking of a vehicle door lock.

19. The actuator as defined in claim 18 further providing for superlocking of the vehicle door lock.

20. The actuator as defined in claim 1, wherein the output positions of the output member are located on an arc of a circle.

21. The actuator as defined in claim 1, wherein the motor is connected with the cam via a centrifugal clutch.

22. The actuator as defined in claim 1, wherein the motor is connected with the cam via a sear and pinion arrangement.

23. A kit of parts for assembly to provide an actuator, comprising:

a motor;

a pair of cams, wherein the motor is in driving connection with the pair of cams, and wherein the pair of cams is rotatable about a cam axis, each cam having a different cam profile and only one of which is assembled into the actuator;

a cam follower;

an output member, wherein rotation of the assembled cam causes the cam follower to be radially displaced relative to the cam axis to provide first and second output positions of the output member, wherein the cam profile includes a radial stop which, in conjunction with the cam follower, act as a detent so that the cam follower is capable of controlling the position of the assembled cam, and wherein the motor is powered in a single direction to move the output member from the first output position to the second output position and is driven in the single direction to move the output member from the second output position to the first output position.

* * * * *